US007198154B2

(12) United States Patent
Tippey

(10) Patent No.: US 7,198,154 B2
(45) Date of Patent: Apr. 3, 2007

(54) COMPRESSED PACKAGE HAVING AN EXPANSION MECHANISM

(75) Inventor: Darold Dean Tippey, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 448 days.

(21) Appl. No.: 10/682,108

(22) Filed: Oct. 9, 2003

(65) Prior Publication Data

US 2005/0077200 A1 Apr. 14, 2005

(51) Int. Cl.
*B65D 73/00* (2006.01)

(52) U.S. Cl. ..... 206/494; 206/440; 206/459.5; 206/497

(58) Field of Classification Search ..... 206/440, 206/494, 449, 459.5, 497; 383/2, 203, 205; 221/45, 64, 65, 241, 244
See application file for complete search history.

(56) References Cited

U.S. PATENT DOCUMENTS

| | | | | |
|---|---|---|---|---|
| 1,846,949 | A | 2/1932 | Clark | |
| 2,611,272 | A | 9/1952 | Jaikanen | |
| 3,145,840 | A | 8/1964 | Wright | |
| 3,197,062 | A | 7/1965 | Day et al. | |
| 3,632,010 | A | 1/1972 | Marty, Sr. | |
| 3,746,066 | A | 7/1973 | McIntyre | |
| 4,414,788 | A | 11/1983 | Berg | |
| 4,724,976 | A | 2/1988 | Lee | |
| 4,934,535 | A | 6/1990 | Muckenfuhs et al. | |
| 5,050,742 | A | 9/1991 | Muckenfuhs | |
| 5,219,421 | A | 6/1993 | Tipping | |
| 5,282,687 | A | 2/1994 | Yee | |
| 5,377,837 | A | 1/1995 | Roussel | |
| 5,379,897 | A | 1/1995 | Muckenfuhs et al. | |
| 5,464,285 | A | 11/1995 | Anderson | |
| 5,743,447 | A | 4/1998 | McDermott | |
| 5,934,470 | A | 8/1999 | Bauer et al. | |
| 5,987,833 | A | 11/1999 | Heffelfinger et al. | |
| 6,427,839 | B1 * | 8/2002 | Helfer-Grand | 206/494 |
| 6,698,928 | B2 * | 3/2004 | Miller | 383/205 |
| 6,729,471 | B2 | 5/2004 | O'Connor et al. | |
| 2001/0032797 | A1 | 10/2001 | Kreider | |
| 2002/0112982 | A1 * | 8/2002 | Stagray et al. | 206/494 |
| 2003/0115837 | A1 | 6/2003 | Zimmer et al. | |

FOREIGN PATENT DOCUMENTS

| | | |
|---|---|---|
| EP | 0 413 122 A1 | 2/1991 |
| EP | 1 074 481 A1 | 2/2001 |

(Continued)

*Primary Examiner*—Luan K. Bui
(74) *Attorney, Agent, or Firm*—Sebastian C. Pugliese, III

(57) ABSTRACT

A package is disclosed having an enclosed compartment with a pair of oppositely aligned walls and a perimeter. An array of compressible articles is retained in the enclosed compartment. The package also includes an expansion mechanism for allowing the enclosed compartment to be enlarged. The expansion mechanism includes a pliable member positioned about the perimeter. A release strip is positioned across the expansion mechanism. The release strip is capable of being at least partially removed to allow the enclosed compartment to be enlarged as the pliable member expands or stretches. The package can also contain an opening mechanism for allowing the package to be opened so that the articles can be removed from the enlarged compartment.

35 Claims, 2 Drawing Sheets

FOREIGN PATENT DOCUMENTS

| | | | |
|---|---|---|---|
| EP | 1 092 651 | A | 4/2001 |
| EP | 0 942 881 | B1 | 10/2001 |
| EP | 0 780 325 | B1 | 10/2002 |
| GB | 2 310 652 | A | 9/1997 |
| JP | 08-011865 | A | 1/1996 |
| WO | WO 01/07336 | A1 | 2/2001 |

* cited by examiner

COMPRESSED PACKAGE HAVING AN EXPANSION MECHANISM

BACKGROUND OF THE INVENTION

Today many manufacturers are using compression packaging to reduce the size and volume of their packages. A smaller package reduces distribution and shipping costs while providing the same number of products to the consumer. A smaller package also requires less shelf space at a retail store which means that additional packages can be stocked and displayed for sale in a similar size area as was used for the larger size packages. Compression packaging works especially well for absorbent articles, such as diapers, training pants, adult incontinent garments, feminine napkins, adult incontinent pads, wet wipes, facial tissue, etc. which normally contain air. Absorbent articles can be compressed to eliminate air within the product as well as to flatten or downsize the actual product. One trade off with a more densely compressed package is that it is usually harder to withdraw the first few articles from the opened package.

Various package designs have been tried to alleviate this problem but most have had only modest in-use success. For absorbent articles in particular, the articles are designed for various age groups. For example, diapers designed for infants and young children normally require a parent or caregiver to remove the article from the package while at the same time restraining the infant or child. This means that sometimes the parent or caregiver has only one hand available to remove the diaper from the package. As for older adults using incontinent pads and undergarments, many suffer from arthritis in their hands and/or poor eyesight and it may be difficult for them to extract a single article from a highly compressed package.

Now a package has been developed that utilizes a unique design that allows the package and articles retained therein to be compressed and still provides for easy removal of the first few articles by the ultimate consumer. The design incorporates an expansion mechanism which allows the package to increase in size and volume before it is actually opened so that each article can be easily removed.

SUMMARY OF THE INVENTION

A package is disclosed having an enclosed compartment with a pair of oppositely aligned walls and a perimeter. An array of compressible articles is retained in the enclosed compartment. The package is designed to be distributed, shipped and sold at a retail outlet in a compressed condition. After the package and its enclosed compressed articles have been purchased by the ultimate consumer, an expansion mechanism formed in the package can be activated which allows the enclosed compartment to become enlarged. The expansion mechanism includes a pliable member positioned about the perimeter of the package. The pliable member is retained in an initial state by a release strip which prevents the pliable member from expanding or stretching until the release strip is removed. Once the release strip is at least partially removed, the expansion mechanism will be activated and the enclosed compartment will be enlarged. The package can also contain an opening mechanism which is designed to be opened after the expansion mechanism has been activated. The opening mechanism will allow the package to be opened so that the articles can be either individually removed from the enlarged compartment or be removed as a group of two or more articles.

DETAILED DESCRIPTION

Figure 1:
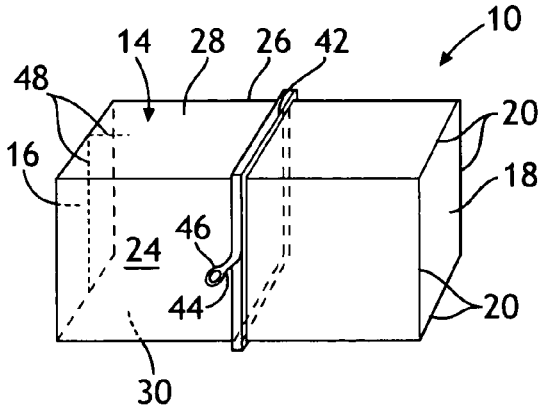
FIG. 1 is a perspective view of a package showing a release strip secured to its perimeter and an opening mechanism formed in a portion of the perimeter.

Referring to FIGS. 1–4, a package 10 is shown which is adapted to retain an array of compressible articles 12. By "compressible" is meant that the articles 12 are capable of being compressed in one or more directions. By "compress" it is meant to press or squeeze together, to shorten or condense, to flatten laterally or lengthwise. For example, the volume of the package 10 may be reduced. The package 10 could be compressed by using vacuum. The compressible articles 12 can be absorbent articles, for example, disposable absorbent articles. The compressible articles 12 can be infant diapers, training pants or adult incontinent garments including undergarments, briefs and pants. The compressible articles 12 can also be incontinent pads, feminine sanitary napkins, pantyliners, menstrual pants, wet wipes, facial tissue, paper towels, paper napkins, or any other absorbent article known to those skilled in the art. Furthermore, the compressible articles 12 can be non-absorbent articles that are capable of being compressed. Examples of non-absorbent articles include clothing, some foods, medicines, some sporting goods, etc. When the articles 12 are compressed, air located in and/or between adjacent articles can be squeezed, or drawn out by vacuum, to make a smaller, denser package.

Such articles 12 are capable of expanding or enlarging once the compressive force is removed, such as when the package 10 is opened.

The package 10 includes an enclosed compartment 14 having a pair of oppositely aligned walls 16 and 18 and a perimeter 20. Other structure forming the package will be explained shortly. The perimeter 20 is measured about the outer periphery of the package 10. The package 10 can be constructed from various materials, including a flexible material such as paper or a thermoplastic material. Other materials from which the package 10 can be constructed include plastic, plastic film, plastic laminate, a blend of two or more plastic materials, a blend of paper and a plastic material, a non-woven, or a cloth material such as cotton, nylon, rayon, polyester, etc. Other kinds of materials known to those skilled in the art can also be used. It is desirable that the package 10 be formed from a non-rigid, pliable material. However, one or more walls or surfaces of the package 10 can be semi-rigid in structure. By "semi-rigid" it is meant a material that may be stiff in at least one direction but can be easily bent or distorted in one or more directions. Examples of some semi-rigid materials include different grades of cardboard, paper board, a stiff plastic sheet, blended films, laminates, a thin wood veneer, etc. Desirably, the package 10 is formed from a flexible material that can itself be compressed after a plurality of compressible articles 12 are inserted therein. The flexible material is dimensionally stable once the package 10 is compressed and sealed and will maintain its dimensions while subjected to pressure from within the package 10 until the package 10 is allowed to expand or is opened. Polypropylene or polyethylene film, as well as a laminate formed therefrom are flexible materials that are commercially available today. The plastic film can have almost any thickness but a thickness of less than about 5 millimeters (mm) is useful for most packages. A film material having a thickness of between about 1 to about 5 mm can be very cost effective, especially when large quantities of packages need to be manufactured. Flexible plastic bags and packages constructed from a thin sheet of material are very advantageous to use since they are compressible and do not have rigid corners.

Figure 2:
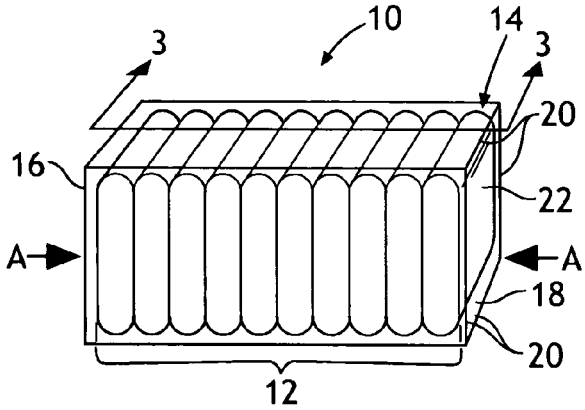
FIG. 2 is a perspective view of the package shown in FIG. 1, depicting an array of absorbent articles retained therein.

Referring to FIG. 2, each of the compressible articles 12 retained in the enclosed compartment 14 has at least one planar surface 22 aligned substantially parallel to at least one of the pair of oppositely aligned walls 16 and 18. By "planar" is meant a relatively flat surface having two dimensions, for example a length and a width. The array of compressible articles 12 are held or retained within the enclosed compartment 14 in a compressed condition and in a direction that is substantially perpendicular to the planar surface 22. In FIG. 2, the direction of compression is indicated by the two arrows, labeled "A".

Referring again to FIG. 1, a six sided flexible and compressible package 10 is shown having a front wall 24 and a back wall 26 joined to one another by the pair of side walls 16 and 18. The package 10 also has a top wall 28 and a bottom wall 30 joined to the other walls 16, 18, 24 and 26 to form the enclosed compartment 14. The perimeter 20 of the package 10 extends from the front wall 24 around the top wall 28, the back wall 26 and the bottom wall 30. Another way of measuring the perimeter 20 is from the front wall 24 around the side wall 16, the back wall 26 and the other side wall 18. The terms: "top, bottom, front, back and sides" are used to describe the orientation of the package 10, as shown. However, it should be noted that the package 10 can be rotated or reoriented such that what was the top wall 28 can become a side wall, or a back wall, etc.

Figure 3:
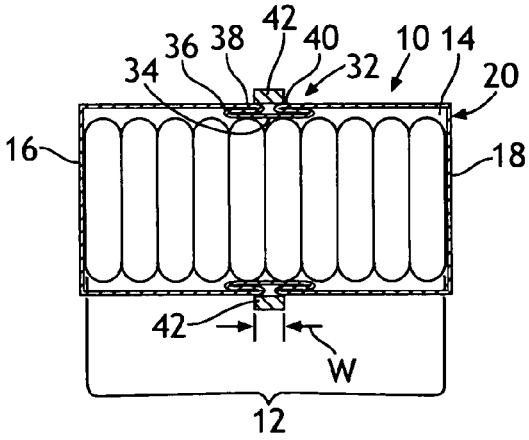
FIG. 3 is a cross-sectional view of FIG. 2 taken along line 3—3 showing an expansion mechanism held in position by a removable release strip.

Referring now to FIG. 3, the package 10 contains an expansion mechanism 32 which allows the enclosed compartment 14 to be enlarged. By "enlarged" it is meant that the internal volume or size of the enclosed compartment 14 can become bigger. The expansion mechanism 32 includes a pliable member 34 positioned about at least a portion of the perimeter 20. The pliable member 34 can be formed from an elastic material, a stretchable material, a folded material, a flexible material, a material that can be elongated but has little or no contraction properties or from other materials having extension characteristics. The pliable member 34 can be formed from the same material from which the package 10 is constructed of and both materials can be integrally formed. Alternatively, the pliable member 34 can be a separate member having different characteristics and properties from the material forming the package 10. Desirably, the expansion mechanism 32 will completely encircle or surround the perimeter 20. A complete encircling of the perimeter 20 would be 360 degrees. Alternatively, the expansion mechanism 32 could extend around only a portion of the perimeter 20. A portion of the perimeter 20 could range from between about 90 degrees to about 359 degrees. Desirably, a portion of the perimeter 20 will extend over at least 270 degrees.

In FIG. 3, the expansion mechanism 32 is depicted as a pleat 36 formed by folding the four adjacent walls 24, 28, 26 and 30 inward about the perimeter 20. The pleat 36 is situated within the enclosed compartment 14 and is out of site of the ultimate purchaser of the package 10. However, it should be noted that the pleat 36 could be constructed on the outside of the enclosed compartment 14, if desired. The size of the pleat 36, as well as the amount of material forming the pleat 36, the overall shape of the pleat 36, how the pleat 36 is folded, and its location on the perimeter 20 can be varied to suit one's particular needs and desires. For example, the pleat 36 could be situated an equal distance between the side walls 16 and 18 or it can be located nearer to one of the walls, 16 and 18. The pleat 36 could also be constructed such that it surrounds only a portion of the perimeter 20. For example, the pleat 36 could encircle 270 degrees or more of the perimeter 20. In order to facilitate expansion of the enclosed compartment 14 however, it is desirable to construct the pleat 36 such that it encompasses from about 300 to about 360 degrees of the perimeter 20.

Still referring to FIG. 3, the pleat 36 has a first end 38 and a second end 40. The first end 38 can be spaced away from the second end 40, as shown, or the first end 38 can abut, touch or overlap the second end 40, if desired. The first and second ends, 38 and 40 respectively, are secured or connected to the material forming the package 10. A removable release strip 42 covers the expansion mechanism 32. In FIG. 3, the removable release strip 42 bridges across the first and second ends, 38 and 40 respectively, of the pleat 36. The dimensions of the release strip 42 can vary to accommodate the expansion mechanism and/or to suit one's package size and configuration. The release strip 42 can be formed from a material that is identical to or is the same material as was used to construct the package 10. Likewise, the release strip 42 can be constructed from a material that is different from the material from which the package 10 is constructed. Desirably, the release strip 42 will be formed from a different material since the properties of the release strip 42 most likely will be different from the properties of the material forming the package 10. The release strip 42 should be removeably secured to either the material forming the package 10 or to the material forming the expansion mechanism 32.

In FIG. 3, the release strip 42 is shown being removeably secured to the material forming the package 10 but is aligned adjacent to the first and second ends, 38 and 40 respectively, of the pleat 36. The release strip 42 can be secured or attached to the package 10 or to the expansion mechanism 32 by ultrasonics, by adhesive, by microwave, by heat, by pressure, or by both heat and pressure. The release strip 42 can also be secured or attached to the package 10 by one or more frangible lines, tear lines or perforation lines. Furthermore, the release strip 42 can also be secured or attached to the package 10 by areas of weakness. An area of weakness can have a width dimension that is much greater than that of a line. The width dimension of an area of weakness can be uniform or non-uniform. For example, an area of weakness can consist of a predetermined pattern of perforations formed in the package 10 and covering a width dimension of about 10 millimeters. Other means for removable attaching the release strip 42 to the package 10 or to the expansion mechanism 32 that are known to those skilled in the art can also be used. One example includes forming the release strip 42 from the same material as the package 10 and connecting the release strip 42 to the package 10 by a pair of adjacently aligned tear lines. As the release strip 42 is removed, a clean break is formed at the tear lines. The expansion mechanism 32 is then free to extend or expand so as to increase the interior size and volume of the enclosed compartment 14.

Figure 4:
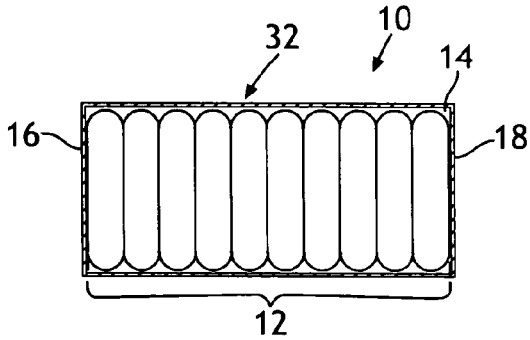
FIG. 4 is a cross-sectional view of the package shown in FIG. 3 after the release strip has been removed and the enclosed compartment has assumed an enlarged configuration.

In FIG. 3, the release strip 42 is shown as a separate band encircling the entire perimeter 20 and is designed to be completely torn or separated from the package 10 so as to allow the pleat 36 to open up as depicted in FIG. 4. The release strip 42 has a width (w) that can vary to suit one's particular needs. The release strip 42 can have a width (w) that is less than about 60 millimeters, desirably, less than about 30 mm, and most desirably, less than about 20 mm. A release strip having a narrower width usually cost less.

In FIG. 4, the pleat 36 has unfolded into a straight or linear profile to enable the enclosed compartment 14 to expand. The expansion mechanism 32 can be sized and configured to allow the volume of the enclosed compartment 14 to be enlarged by at least about 5%. Desirably, the expansion mechanism 32 can be sized and configured to allow the volume of the enclosed compartment 14 to be enlarged from between about 5% to about 100%. Most desirably, expansion mechanism 32 can be sized and configured to allow the volume of the enclosed compartment 14 to be enlarged from between about 10% to about 50%. The enclosed compartment can also be enlarged from between about 10% to about 40%, from between about 15% to about 30%, or from between about 15% to about 25%. The exact amount of expansion of the enclosed compartment 14 will be dictated by the size of the package 10, the size, number and kind of articles 12 contained therein, as well as other factors such as the expansion capability of the articles 12 themselves.

Returning to FIG. 1, the release strip 42 is shown having a terminal end 44 and having a pull tab 46 secured or connected to the terminal end 44. The pull tab 46 can be sized and shaped as a finger ring or have some other geometrical configuration. The dimensions of the pull tab 46 can be designed to easily fit between a persons thumb and index finger so that it can be easily grasped. The pull tab 46 can be a solid piece of material or be in the shape of a ring having an opening formed therein. The function of the pull tab 46 is to provide an easy means for the consumer to remove the release strip 42 from the perimeter 20 of the package 10. FIG. 1 also shows an opening mechanism 48 in the form of a frangible tear strip. However, the opening mechanism 48 can be a zip lock strip, a zipper, a Velcro® attachment, etc. The opening mechanism 48 can be formed in one wall or in two or more walls. In FIG. 1, the opening mechanism 48 is a frangible tear strip formed in the side wall 16 and also in the adjacent top wall 28. The opening mechanism 48 is a continuous line although two or more non-continuous lines or areas of weakness can be utilized. The opening mechanism 48 can be a perforated line, a line formed by necking the package material down to a thinner thickness so as to make it easier to tear open, two or more frangible lines aligned essentially parallel to one another, two or more breakable lines arranged at an angle to one another, one or more perforation lines, an area of weakness, etc. A single tearable line works well on plastic film packages of rather thin thickness. It should be noted that although the opening mechanism 48 has been described as one or more frangible lines, that it could be formed from other structures as well. One benefit of forming the opening mechanism 48 as one or more tearable lines is that when the tearable line is broken by pulling the material on either side of the line apart, a clean break occurs. This is an important aesthetic feature that many consumers like. The opening mechanism 48 can be colored or tinted so as to be made more visible relative to the color or graphics of the package 10. A visually distinctive opening mechanism 48 can catch the attention of the consumer's eyes and aids them in properly opening the package 10.

Referring again to FIG. 4, the package 10 is shown in an enlarged state where the volume of the enclosed compartment 14 has increased and the compressed articles 12 have had the opportunity to move outward so that they are no longer so densely compacted together. In this condition, the package 10 can be opened, such as by the opening mechanism 48 or simply by tearing the flexible material so as to allow easy removal of the articles 12. The articles 12 can be either individually removed or be removed in groups of two or more articles.

Figure 5:
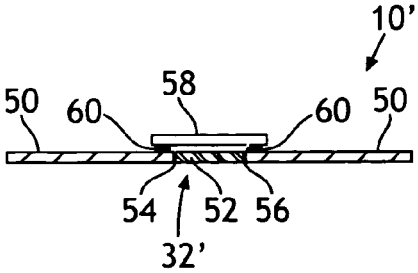
FIG. 5 is a cross-sectional view of a portion of a package exhibiting an alternative expansion mechanism utilizing a stretchable material retained in a contracted state by a removable release strip.
Figure 6:
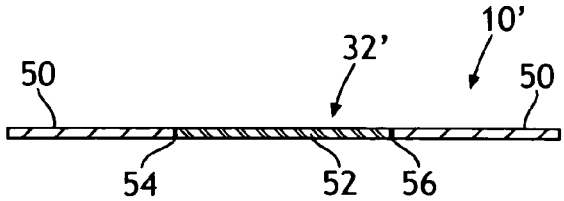
FIG. 6 is a cross-sectional view of the portion of the package shown in FIG. 5 after the release strip has been removed and the stretchable material has expanded to an elongated configuration.

Referring now to FIGS. 5 and 6, a cross-section of an alternative embodiment is depicted. In this embodiment, a portion of a wall 50 forming a package 10' is shown having an alternative expansion mechanism 32'. The expansion mechanism 32' is an elastic member 52 secured to at least a portion of the perimeter of the package 10'. In FIG. 5, the elastic member 52 is in a contracted or non-stretched state having first and second ends, 54 and 56 respectively, secured in an integral manner to the material forming the wall 50 of the package 10'. As shown, the elastic member 52 is aligned flush with the outer surface of the wall 50. A release strip 58 bridges across the elastic member 52 and is removeably attached to the wall 50 by two lines of adhesive 60. The lines of adhesive 60 can be continuous lines or intermittent lines of adhesive. It should be noted that the release strip 58 can be removeably held in position by other forms of attachments known to those skilled in the art. Once the release strip 58 is removed, the elastic member 52 can stretch or expand in a longitudinal direction, as is shown in FIG. 6. As the elastic member 52 stretches, the enclosed compartment of the package 10' will increase in size. This expansion will occur as the force of the compressed articles 12 push on the opposite end of the package 10'. The interior volume of the package 10' will increase until the force needed to stretch the elastic member 52 equals the force exerted on the ends of the package 10' by the expansion of the compressed articles 12 or until the elastic member 52 has reached its maximum possible extension. It is not anticipated that the elastic member 52 will break but this could occur if the force is excessive. The initial length of the elastic member 52 and the force required to stretch it to its maximum length can all be calculated so that an adequate length of elastic member 52 can be utilized.

Figure 7:
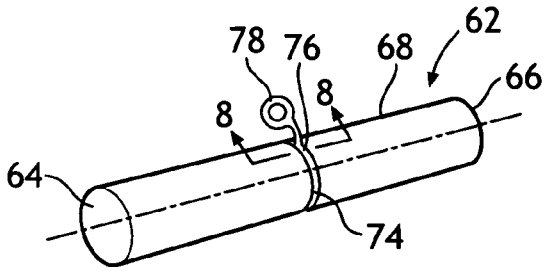
FIG. 7 is a perspective view of a cylindrically shaped, flexible package showing a release strip having a pull tab.
Figure 8:
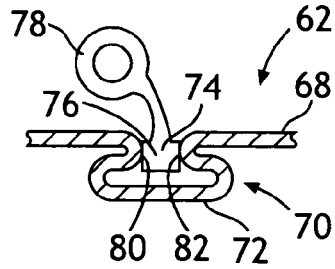
FIG. 8 is a cross-sectional view of a portion of the package shown in FIG. 7 taken along line 8—8 depicting an expansion mechanism in the form of a pleat and a release strip formed flush with the exterior perimeter of the package.
Figure 9:
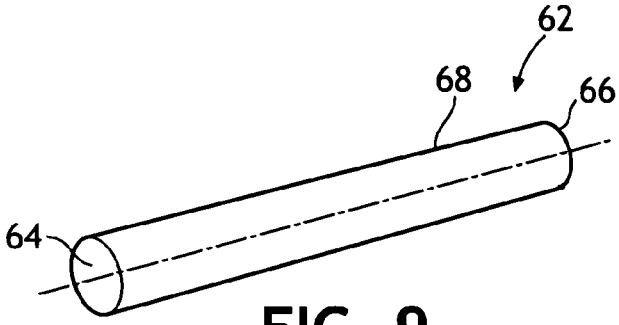
FIG. 9 is a perspective view of the cylindrically shaped, flexible package shown in FIG. 7 once the release strip has been removed and the package has been allowed to expand.

Referring now to FIGS. 7, 8 and 9, a cylindrically shaped, flexible package 62 is shown having a pair of oppositely aligned walls 64 and 66 and a perimeter 68. The package 62 has an expansion mechanism 70 in the form of a pleat 72. A release strip 74 is formed flush with the outside perimeter 68. The release strip 74 has a terminal end 76 to which is secured a pull tab 78. The pull tab 78 is depicted as a hollow finger ring although it can be configured into various geometrical shapes. The release strip 74 is secured to the pleat 72 by a pair of frangible tear lines 80 and 82. As one pulls on the pull tab 78, the release strip 74 will tear away from the pleat 72 at the pair of tear lines 80 and 82. This action will provide a clean separation of the release strip 74 from the package 62. Once the release strip 74 is removed, the pleat 72 can expand or extend into a linear configuration as is shown in FIG. 9. As the pleat 72 unfolds, the enclosed compartment of the package 62 will increase in size. This expansion will occur as the force of the compressed articles retained within the package 62 push on the pair of oppositely aligned walls 64 and 66. In FIG. 9, one will notice that the external periphery of the package 62 in the enlarged state is essentially uniform in diameter. This structure is accomplished by initially forming the release strip 74 flush with the outside perimeter 68.

Figure 10:
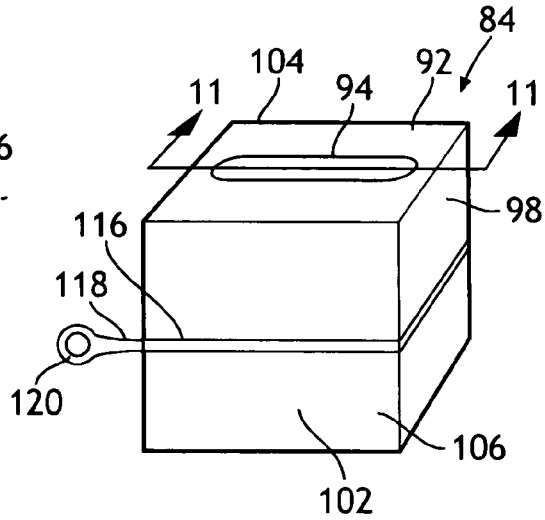
FIG. 10 is a perspective view of a flexible package having a pair of oppositely aligned walls with at least one of the pair of oppositely aligned walls being a semi-rigid wall.
Figure 11:
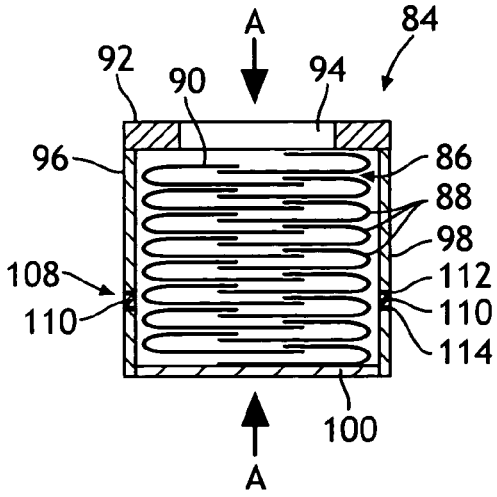
FIG. 11 is a cross-sectional view of the package shown in FIG. 10 taken along line 11—11 depicting a plurality of interleaved articles which can be individually removed through the opening.
Figure 12:
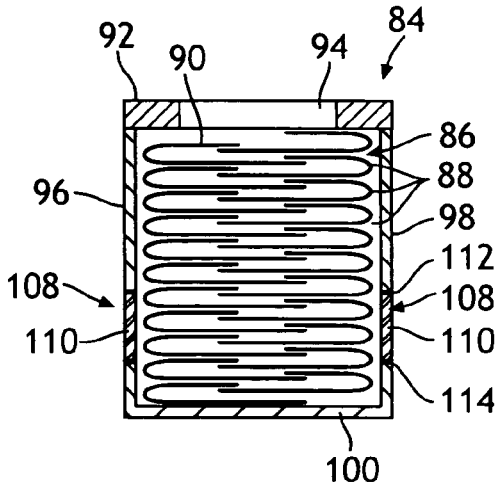
FIG. 12 is a cross-sectional view of the package shown in FIG. 11 after the release strip has been removed and the enclosed compartment has assumed an enlarged configuration.

Referring now to FIGS. 10, 11 and 12, a flexible package 84 is shown having an enclosed compartment 86 for retaining an array of compressible articles 88. Each compressible article 88 has at least one planar surface 90 and each is folded into an interleaf arrangement. The interleaf arrangement allows an adjacent article 88 to advance towards an outlet formed in the package 84 as the first article 88 is removed. The compressible articles 88 can be disposable absorbent articles. For example, the compressible articles 88 can be facial tissue, wet wipes, paper towels, or any other kind of relatively flat article. The compressible articles 88 do not have to be absorbent articles as long as they can be compressed. The number of articles 88 retained in the enclosed compartment 86 of the package 84 can vary from a few to several thousand. Desirably, the number of articles 88 retained in the enclosed compartment 86 can range from about 20 to about 500. More desirably, the number of articles 88 retained in the enclosed compartment 86 can range from about 25 to about 300. Most desirably, the number of articles 88 retained in the enclosed compartment 86 can range from about 50 to about 250.

Still referring to FIGS. 10–12, the package 84 is different from the previously described packages 10, 10' and 62 in that it has a semi-rigid top wall 92 having an opening 94 formed therein. By "semi-rigid" it is meant a material that may be stiff in at least one direction but can be easily bent or distorted in one or more directions. The semi-rigid top wall 92 can be constructed from cardboard, thick paper, a composite of several layers of similar or different materials, a stiff thermoplastic material, such as polypropylene or polyethylene film, a stiff plastic, a laminate, etc. Some or all of the remaining walls of the package 84 can be constructed from a thin, flexible plastic material. In FIGS. 10–12, the side walls 96 and 98, the bottom wall 100, the front wall 102 and the back wall 104 are all thinner than the top wall 92. Desirably, all of these walls 96, 98, 100, 102 and 104 are formed from a thin plastic material and are very flexible and pliable.

It should be noted that the planar surface 90 of each article 88 is aligned parallel to the top wall 92 in the package 84. In addition, the articles 88 are held in compression in a direction that is substantially perpendicular to the planar surface 90. In FIG. 11, the direction of compression is indicated by the two arrows, labeled "A".

In FIGS. 10–12, it should be noted that the bottom wall 100 is oppositely aligned to the semi-rigid top wall 92. The package 84 also has a perimeter 106 and an expansion mechanism 108 for allowing the enclosed compartment 86 to be enlarged. The expansion mechanism 108 includes an elastic member 110 secured to at least a portion of the perimeter 106 of the package 84. In FIGS. 10 and 11, the elastic member 110 is in a contracted or non-stretched state. The elastic member 110 has a first end 112 and a second end 114. The first and second ends 112 and 114 are secured to the material forming the walls 96, 98, 102 and 104 of the package 84. As indicated, the elastic member 110 extends around the perimeter 106.

Referring again to FIG. 10, the package 84 contains a release strip 116 that bridges across the elastic member 110 and is removeably attached to the walls 96, 98, 102 and 104 of the package 84. The release strip 116 has a terminal end 118 to which is secured a pull tab 120. The pull tab 120 is depicted as a hollow finger ring although it can be configured into various geometrical shapes. The release strip 116 can be secured to the elastic member 110 by one or more frangible tear lines or by one or two rows of adhesive (not shown). As one pulls on the pull tab 120, the release strip 116 will tear away from the elastic member 110. This action will provide a clean separation of the release strip 116 from the package 84.

The method of removeably securing the release strip 116 to the package 84 can be the same as was explained above for the various embodiments. Once the release strip 116 has been removed, the elastic member 110 can stretch or expand in a longitudinal direction as is shown in FIG. 12. As the elastic member 110 stretches, the enclosed compartment 86 will increase in size. This expansion will occur as the force of the compressed articles 88 expand and push on the top and bottom walls, 92 and 100 respectively. The interior volume of the package 84 will thereby become larger. The initial length of the elastic member 110 and the force required to stretch it to its maximum length can all be calculated so that an adequate length of elastic member 110 can be utilized.

It should be noted that each of the packages described above, or a wrapper enclosing the packages described above, can also include indicia or instructions. The indicia or instructions can be located on or adhered to a surface of the package or wrapper, or it can be printed on a card that is inserted into the wrapper or attached to an outside surface of the package. The indicia or instructions can inform and instructs a consumer or caregiver on a method of how to activate the expansion means to increase the size and volume of the package. Once the package has been enlarged, the indicia or instructions can also inform and instruct the consumer or caregiver on a method of how to open and remove individual or multiple articles from the package. The indicia can include identifying marks, symbols, indications, markings, icons, graphics, stamps, stickers, etc. that can be printed, attached or somehow secured to the package or a wrapper enclosing the package. When a wrapper is used, it can be formed from a clear material such as a clear film which will allow the indicia or instructions to be easily read when the indicia or instructions are placed on the package itself. Alternatively, the indicia or instructions can be placed on the inside or outside of the wrapper. Some or all of the indicia or instructions can be in a color different from that of the package or the wrapper. The instructions can include one or more words that are presented as a short blurb, or be formed into sentences or paragraphs. Besides a written description, the instructions can include drawings, pictures, photographs, etc. The instructions can be presented in one or more languages, for example in English, Spanish, German, French, Japanese, etc.

The indicia or instructions are designed to inform the consumer or caregiver of a convenient method of expanding or enlarging the package and then opening the package. After the package has increased in size and volume, the package can be opened so that individual or multiple articles can be easily removed by the consumer or caregiver. Additionally, the indicia or instructions can also inform the consumer or caregiver how to close or reseal the package to keep the remaining articles clean.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

I claim:

1. A package comprising:

a) an enclosed compartment having a pair of oppositely aligned walls and a perimeter;

b) an array of compressible articles retained in said enclosed compartment, said articles having at least one planar surface aligned substantially parallel to at least one of said pair of oppositely aligned walls and being held in compression in a direction that is substantially perpendicular to said planar surface;

c) expansion means for allowing said enclosed compartment to be enlarged, said expansion means including a pliable member positioned about said entire perimeter, and d) a release strip bridging said expansion means and capable of being at least partially removed to allow said enclosed compartment to be enlarged by said pliable member; and e) opening means for allowing said package to be opened so that said articles can be removed from said enlarged compartment, said opening means being distinct from said expansion means, said opening means being formed in at least one of said walls.

2. The package of claim 1 wherein said pliable member is a separate member.

3. The package of claim 2 wherein said pliable member is an elastic material.

4. The package of claim 2 wherein said pliable member is a stretchable material.

5. The package of claim 1 wherein said package and said expansion means are formed from the same material.

6. The package of claim 1 wherein said package and said expansion means are integrally formed.

7. The package of claim 1 wherein at least one of said pair of oppositely aligned walls is a semi-rigid wall.

8. The package of claim 7 wherein said semi-rigid wall is formed from cardboard.

9. The package of claim 1 wherein said expansion means allows the volume of said enclosed compartment to be enlarged by at least about 5%.

10. The package of claim 1 wherein instructions are included on said package for informing a consumer on how to dispense said compressible articles from said package by activating said expansion means whereby the size and volume of said package can be increased prior to opening said package to permit individual or multiple articles to be easily removed.

11. The package of claim 1 wherein said package is enclosed by a wrapper and instructions are placed between said package and said wrapper for informing a consumer on how to dispense said compressible articles from said package by activating said expansion means whereby the size and volume of said package can be increased prior to opening said package to permit individual or multiple articles to be easily removed.

12. A package comprising:

a) an enclosed compartment having a pair of oppositely aligned walls and a perimeter;

b) an array of compressible articles retained in said enclosed compartment, said articles having at least one planar surface aligned substantially parallel to at least one of said pair of oppositely aligned walls and said articles being held in compression in a direction that is substantially perpendicular to said planar surface;

c) expansion means for allowing said enclosed compartment to be enlarged, said expansion means including an elastic member secured to said entire perimeter, said elastic member having a first end and a second end;

d) a release strip positioned across first and second ends of said elastic member, said release strip capable of being at least partially removed to allow said elastic member to be stretched thereby enabling said enclosed compartment to be enlarged; and e) opening means for allowing said package to be opened so that said articles can be removed from said enlarged compartment, said opening means being formed in at least one of said walls.

13. The package of claim 12 wherein said opening means is at least one frangible line.

14. The package of claim 12 wherein said expansion means allows the volume of said enclosed compartment to be enlarged by at least about 5%.

15. The package of claim 12 wherein said expansion means allows the volume of said enclosed compartment to be enlarged from between about 5% to about 100%.

16. The package of claim 15 wherein said expansion means allows the volume of said enclosed compartment to be enlarged from between about 10% to about 50%.

17. The package of claim 12 wherein said release strip has a width of less than about 30 millimeters.

18. The package of claim 12 including instructions on said package for informing a consumer on how to dispense said compressible articles from said package by activating said expansion means whereby the size and volume of said package can be increased prior to opening said package to permit individual or multiple articles to be easily removed.

19. The package of claim 12 wherein said package is enclosed by a clear wrapper and instructions are placed between said package and said wrapper for informing a consumer on how to dispense said compressible articles from said package by activating said expansion means whereby the size and volume of said package can be increased prior to opening said package to permit individual or multiple articles to be easily removed.

20. A package comprising:

a) a front wall and a back wall joined to one another by a pair of side walls, and a top wall and a bottom wall joined to said front, back and pair of side walls to form an enclosed compartment having a perimeter;

b) an array of compressible articles housed in said enclosed compartment, said articles having at least one planar surface aligned parallel to at least one of said pair of side walls and said articles being held in compression in a direction that is substantially perpendicular to said planar surface;

c) expansion means for allowing said enclosed compartment to be enlarged, said expansion means including a pleat formed by folding four adjacent walls inward about said perimeter, said pleat having a first end and a second end;

d) a release strip positioned across said first and second ends of said pleat, said release strip capable of being at least partially removed to allow said enclosed compartment to be enlarged; and e) opening means for allowing said package to be opened so that said articles can be removed from said enlarged compartment, said opening means being formed in at least one of said walls.

21. The flexible package of claim 20 wherein said expansion means allows the volume of said enclosed compartment to be enlarged by at least about 5%.

22. The flexible package of claim 20 wherein said release strip is formed from the same material as said package.

23. The flexible package of claim 20 wherein said release strip is formed from a different material than said package.

24. The flexible package of claim 20 wherein said release strip has a terminal end and a pull tab is secured to said terminal end.

25. The flexible package of claim 20 wherein said package is formed from a thermoplastic material.

26. The flexible package of claim 20 wherein said package is formed from plastic.

27. The flexible package of claim 20 wherein said array of compressible articles are disposable absorbent articles.

28. The flexible package of claim 27 wherein said disposable absorbent articles are adult incontinence garments.

29. The flexible package of claim 20 wherein said release strip is secured to said first and second ends of said pleat by ultrasonics.

30. The package of claim 20 including instructions on said package for informing a consumer on how to dispense said compressible articles from said package by activating said expansion means whereby the size and volume of said package can be increased.

31. The package of claim 20 wherein said package is enclosed by a clear wrapper and instructions are placed between said package and said wrapper for informing a consumer on how to dispense said compressible articles from said package by activating said expansion means whereby the size and volume of said package can be increased prior to opening said package to permit individual or multiple articles to be easily removed.

32. A package comprising:

a) an enclosed compartment having a pair of oppositely aligned walls and a perimeter;

b) an array of compressible articles retained in said enclosed compartment, said articles having at least one planar surface aligned substantially parallel to at least one of said pair of oppositely aligned walls and being held in compression in a direction that is substantially perpendicular to said planar surface;

c) expansion means for allowing said enclosed compartment to be enlarged, said expansion means including a pliable member positioned about at least a portion of said perimeter;

d) a release strip bridging said expansion means and capable of being at least partially removed to allow said enclosed compartment to be enlarged by said pliable member; and e) a wrapper enclosing said package with instructions placed between said package and said wrapper for informing a consumer on how to dispense said compressible articles from said package by activating said expansion means whereby the size and volume of said package can be increased prior to opening said package to permit individual or multiple articles to be easily removed.

33. A package comprising:

a) an enclosed compartment having a pair of oppositely aligned walls and a perimeter;

b) an array of compressible articles retained in said enclosed compartment, said articles having at least one planar surface aligned substantially parallel to at least one of said pair of oppositely aligned walls and said articles being held in compression in a direction that is substantially perpendicular to said planar surface;

c) expansion means for allowing said enclosed compartment to be enlarged, said expansion means including an elastic member secured to at least a portion of said perimeter, said elastic member having a first end and a second end;

d) a release strip positioned across first and second ends of said elastic member, said release strip capable of being at least partially removed to allow said elastic member to be stretched thereby enabling said enclosed compartment to be enlarged;

e) opening means for allowing said package to be opened so that said articles can be removed from said enlarged compartment, said opening means being formed in at least one of said walls; and f) a clear wrapper enclosing said package with instructions placed between said package and said wrapper for informing a consumer on how to dispense said compressible articles from said package by activating said expansion means whereby the size and volume of said package can be increased prior to opening said package to permit individual or multiple articles to be easily removed.

34. A package comprising:

a) a front wall and a back wall joined to one another by a pair of side walls, and a top wall and a bottom wall joined to said front, back and pair of side walls to form an enclosed compartment having a perimeter, and said top wall being thicker than said bottom wall;

b) an array of compressible articles housed in said enclosed compartment, said articles having at least one planar surface aligned parallel to at least one of said pair of side walls and said articles being held in compression in a direction that is substantially perpendicular to said planar surface;

c) expansion means for allowing said enclosed compartment to be enlarged, said expansion means including a pleat formed by folding four adjacent walls inward about said perimeter, said pleat having a first end and a second end;

d) a release strip positioned across said first and second ends of said pleat, said release strip capable of being at least partially removed to allow said enclosed compartment to be enlarged;

e) opening means for allowing said package to be opened so that said articles can be removed from said enlarged compartment, said opening means being formed in at least one of said walls; and f) a clear wrapper enclosing said package with instructions placed between said package and said wrapper for informing a consumer on how to dispense said compressible articles from said package by activating said expansion means whereby the size and volume of said package can be increased prior to opening said package to permit individual or multiple articles to be easily removed.

35. A package comprising:

a) an enclosed compartment having a pair of oppositely aligned walls and a perimeter, and one of said pair of oppositely aligned walls being a top wall which is thicker than said other oppositely aligned walls;

b) an array of compressible articles retained in said enclosed compartment, said articles having at least one planar surface aligned substantially parallel to at least one of said pair of oppositely aligned walls and being held in compression in a direction that is substantially perpendicular to said planar surface;

c) expansion means for allowing said enclosed compartment to be enlarged, said expansion means including a pleat formed by folding four adjacent walls inward about said perimeter; and d) a release strip bridging said expansion means and capable of being at least partially removed to allow said enclosed compartment to be enlarged by said pliable member; and e) opening means for allowing said package to be opened so that said articles can be removed from said enlarged compartment, said opening means being distinct from said expansion means, said opening means being formed in at least one of said walls.

* * * * *